US006003646A

United States Patent [19]

Paudler

[11] Patent Number: 6,003,646

[45] **Date of Patent: *Dec. 21, 1999**

[54] METHOD FOR MANUFACTURING SOFT CLOTH DURABLE LUGGAGE

[75] Inventor: Gary Paudler, Summerland, Calif.

[73] Assignee: Patagonia, Inc., Ventura, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,670

[22] Filed: Aug. 7, 1997

[51] Int. Cl.[6] ..... A45C 13/00

[52] U.S. Cl. ..... 190/124; 190/903

[58] Field of Search ..... 156/274.4, 380.2, 156/380.3, 380.6; 190/124, 126, 125, 127

[56] References Cited

U.S. PATENT DOCUMENTS

| | | | |
|---|---|---|---|
| 2,432,365 | 12/1947 | Allen | 190/903 X |
| 2,617,752 | 11/1952 | Hauteville | 156/274.4 X |
| 2,684,319 | 7/1954 | Arnold | 156/380.6 X |
| 2,883,505 | 4/1959 | Manwaring | 156/274.4 X |
| 2,984,287 | 5/1961 | Clason | 156/380.6 |
| 3,345,226 | 10/1967 | Frenkel et al. | 156/274.4 X |
| 3,443,671 | 5/1969 | Dyke | 190/908 X |
| 3,535,196 | 10/1970 | Labertinti et al. | 156/274.4 X |
| 3,725,189 | 4/1973 | Gidge | 156/274.4 X |
| 3,764,433 | 10/1973 | Schneider | 156/274.4 |
| 3,865,166 | 2/1975 | Pedro | 190/908 X |
| 4,352,709 | 10/1982 | Urai et al. | 156/274.4 X |
| 4,424,259 | 1/1984 | Middlebrook | 428/451 |
| 4,703,519 | 10/1987 | Krenzel | 190/903 X |
| 4,817,769 | 4/1989 | Saliba | 190/908 X |
| 5,252,161 | 10/1993 | Chang et al. | 190/125 X |
| 5,360,129 | 11/1994 | Lee | 220/1.5 |
| 5,437,615 | 8/1995 | Pekar et al. | 602/19 |
| 5,458,718 | 10/1995 | Venkitachalam | 156/273.9 |
| 5,529,830 | 6/1996 | Dutta et al. | 428/176 |
| 5,533,992 | 7/1996 | Patel et al. | 604/403 |
| 5,691,846 | 11/1997 | Benson, Jr. et al. | 359/530 |

*Primary Examiner*—Gary E. Elkins
*Assistant Examiner*—Tri M. Mai
*Attorney, Agent, or Firm*—Blakely, Sokoloff, Taylor & Zafman LLP

[57] ABSTRACT

A process for designing durable and esthetically pleasing luggage. The luggage features a top and bottom created from a thermoplastic elastomer. The thermoplastic elastomer provides a durable surface while allowing luggage design in different shapes. A radio frequency process is used to couple different sections of the luggage. This process removes the need for unsightly stitches while simplifying construction. In addition, the lower and upper sections of the luggage are coupled by a zipper mechanism that is not visible from the exterior of the luggage. This protected zipper adds to the durability and esthetic form of the luggage.

5 Claims, 7 Drawing Sheets

METHOD FOR MANUFACTURING SOFT CLOTH DURABLE LUGGAGE

FIELD OF THE INVENTION

The present invention is in the field of luggage design. In particular, the present invention introduces a rugged piece of collapsible (soft) luggage.

BACKGROUND OF THE INVENTION

Most soft luggage designs generally consists of a fabric body having corners formed by cutting, folding and sewing. The luggage is often defined by flexible walls which are typically made from cloth materials. These cloth (or fabric) materials are unable to maintain a defined shape and are easily damaged by corrosive liquids, sharp objects, or excessive friction on a rough surface.

Additionally, resilient material is often affixed onto the side faces of the luggage to provide a rigid construction. This rigid construction prevents the luggage from collapsing inwards when the luggage's contents are removed. The rigid construction also allows the placement of straps, wheels, zippers, and additional compartments (both internal and external). This same design is also utilized in the construction of smaller portable hand luggage. Unfortunately, this standard design has inherent problems.

The standard soft luggage design creates problems over prolonged use. For example, the top and bottom faces of the soft luggage are highly susceptible to damage from contact with pavement, airline luggage containers, and even other luggage. The folded and sewn seams produce points of concentrated wear. To circumvent such problems hard shelled luggage design have been created. Unfortunately, hard shell luggage designs are bulky, difficult to handle, and occupy a large amount space even when the luggage is empty.

Another inherent problem with the standard soft luggage design is the limitation on geometrical shapes. Because the comers of the luggage's flexible walls may be combined with a resilient material, it is necessary to require simple geometric shapes to reduce construction costs. For example, a duffel bag construction with a hexagonal top and bottom face would require resilient material sewn into each of eight sides to create this unique shape. The costs associated with creating this complex design discourages production.

A further problem associated with the standard soft luggage design is the limitation imposed upon styling. In particular, the stitching used to inter-connect the luggage's flexible walls or the stitching used to attach the resilient material appears on the exterior of the luggage, thus detracting from the esthetic appearance of the luggage. This esthetic concern is compounded by the external stitching required to attach straps, zippers, and additional compartments to the luggage.

It is therefore desirable to have a method for designing durable soft luggage that is esthetically pleasing. The method must also be capable of constructing different geometric shapes including curved corners to spread wear over a larger area.

SUMMARY OF THE INVENTION

It is therefore an object of the present invention to introduce a method for designing soft luggage that is durable and esthetically pleasing. The soft luggage design features a method for constructing upper and lower assembly sections. The top of the upper assembly section and/or the bottom of the lower assembly section comprises a thermoformed pan created from a thermoplastic elastomer (TPE). Furthermore, both the upper and lower assembly sections have fabric sides welded to the upper and lower pans. The fabric sides may include zippers sewn and/or radio frequency (RF) welded in a manner which may eliminate visible external stitching. In addition, straps or handles can be RP welded or sewn to the fabric sides of the upper and lower assembly sections.

The radio frequency welding process allows the luggage design to follow any shape based on the shape of the thermoplastic elastomer pans. Subsequent to the welding process, the upper and lower assembly sections can be zipped together.

Other objects, features, and advantages of the present invention will be apparent from the accompanying drawings and from the detailed description which follows below.

DETAIL DESCRIPTION OF THE DRAWINGS

The objects, features and advantages of the present invention will be apparent to one skilled in the art, in view of the following detailed description in which:

FIG. 1 illustrates one embodiment of the present invention where a rectangular top and bottom pan are used and define the shape of the luggage.

FIG. 1*b* illustrates an alternate embodiment of FIG. 1 wherein the zipper is concealed by fabric flaps.

FIG. 2*a* illustrates a view of the top section of one embodiment of the present invention prior to welding of the top pan to the upper fabric assembly.

FIG. 2*b* illustrates a view of the bottom section of one embodiment of the present invention prior to welding of the bottom pan to the lower fabric assembly.

FIG. 3*a* illustrates a cross-section view of a lower section zipper attached to the lower section fabric assembly after the fabric has been folded and welded.

FIG. 3*b* illustrates a cross-section view of the upper section zipper attached to the upper section fabric assembly before or after the fabric has been folded and welded.

DETAIL DESCRIPTION OF THE INVENTION

The present invention is illustrated by way of example and not limitation in the figures of the accompanying drawing, in which like references indicate similar elements. In the following description, for purposes of explanation, specific nomenclature is set forth to provide a thorough understanding of the present invention. However, it will be apparent to one skilled in the art that these specific details are not required in order to practice the present invention.

The Rectangular Shaped Luggage Design

Figure 1:
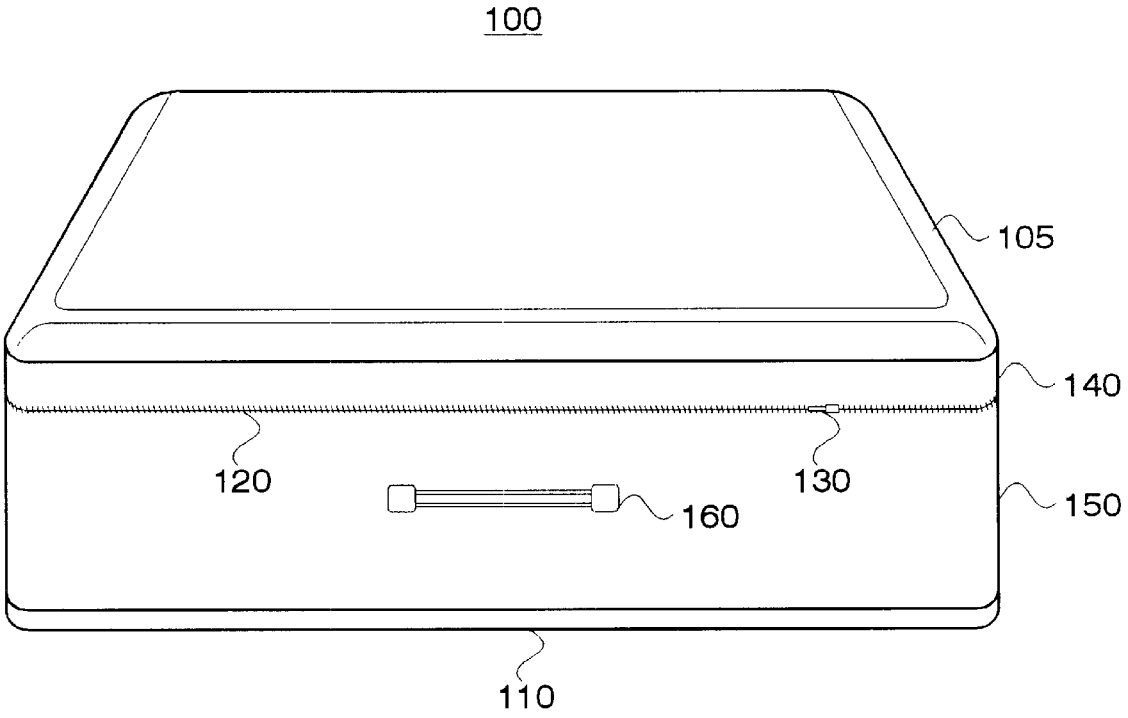
Figure 1B:
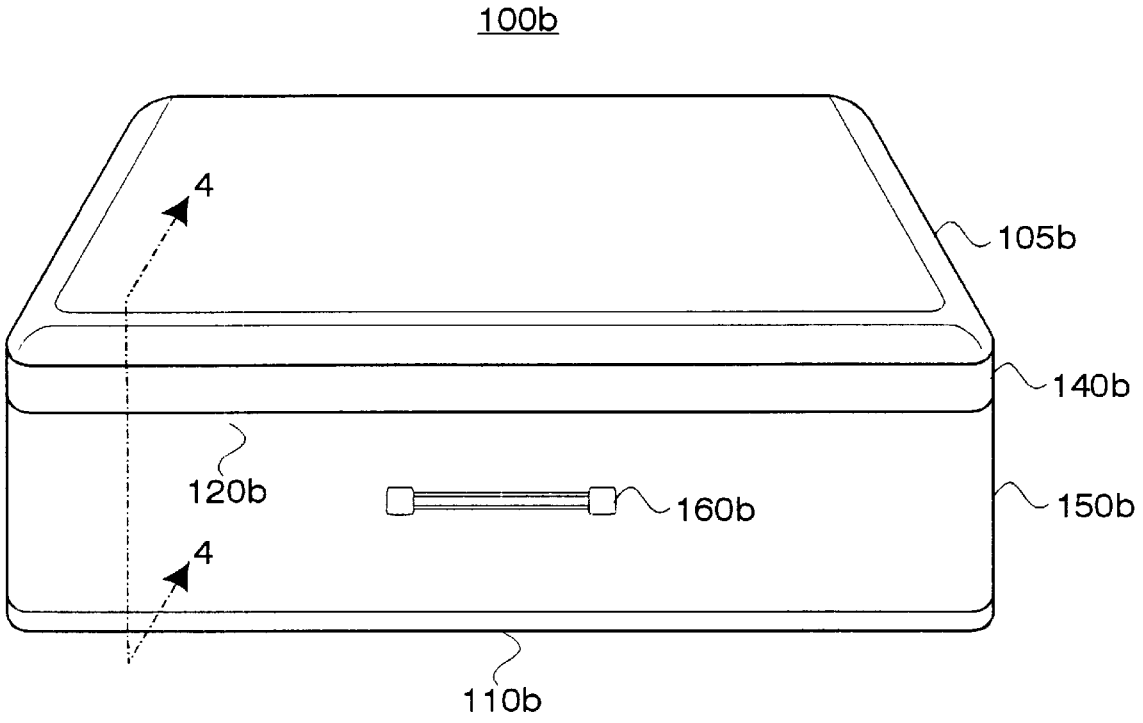

FIG. 1 illustrates a first embodiment of the present invention. Specifically, a soft luggage bag 100 is shown where rectangular shaped pans 105 and 110 form the top and bottom surfaces of the soft luggage bag 100 respectively. The top and bottom pans 105 and 110 are formed from a thermoplastic elastomer. Thermoplastic elastomers are easily thermomolded into a variety of different shapes. The thermoplastic pans provide a strong and durable surface once molding is completed. Accordingly, the use of thermoplastic elastomer in pans 105 and 110 affords luggage bag 100 with a durable design that is more resistant to damage and wear than the standard soft luggage design. Furthermore, the use of thermoplastic elastomers allows for the design of luggage with unique shapes without the complex combinations of materials found in other fabric designs.

Referring to FIG. 1, the upper pan 105 is coupled to an upper fabric assembly 140 using a radio frequency welding process. In one embodiment, the fabric assembly 140 comprises nylon with a lamination or coating of a material compatible for welding to the TPE. The radio frequency welding process connects the upper pan 105 of luggage bag 100 to the nylon fabric side surfaces of upper fabric assembly 140 without any unsightly stitching marks or breaches allowing the passage of fluids. The same radio frequency welding process is used to couple the bottom pan 110 to the laminated or coated surface of lower fabric assembly 150. In one embodiment, a lower handle 160 is also coupled to fabric assembly 150 via radio frequency welding.

The upper fabric assembly 140 is coupled to lower fabric assembly 150 along zipper line 120. A radio frequency weld (not shown) at the back of the luggage may be used to permanently connect the upper fabric assembly 140 to lower fabric assembly 150. This permanent connection acts as a hinge between the two sections. In another embodiment, the zipper line 120 completely surrounds the luggage such that the Zipper 130 can be used to completely separate the upper fabric assembly 140 from lower fabric assembly 150 along zipper line 120.

Figure 4:
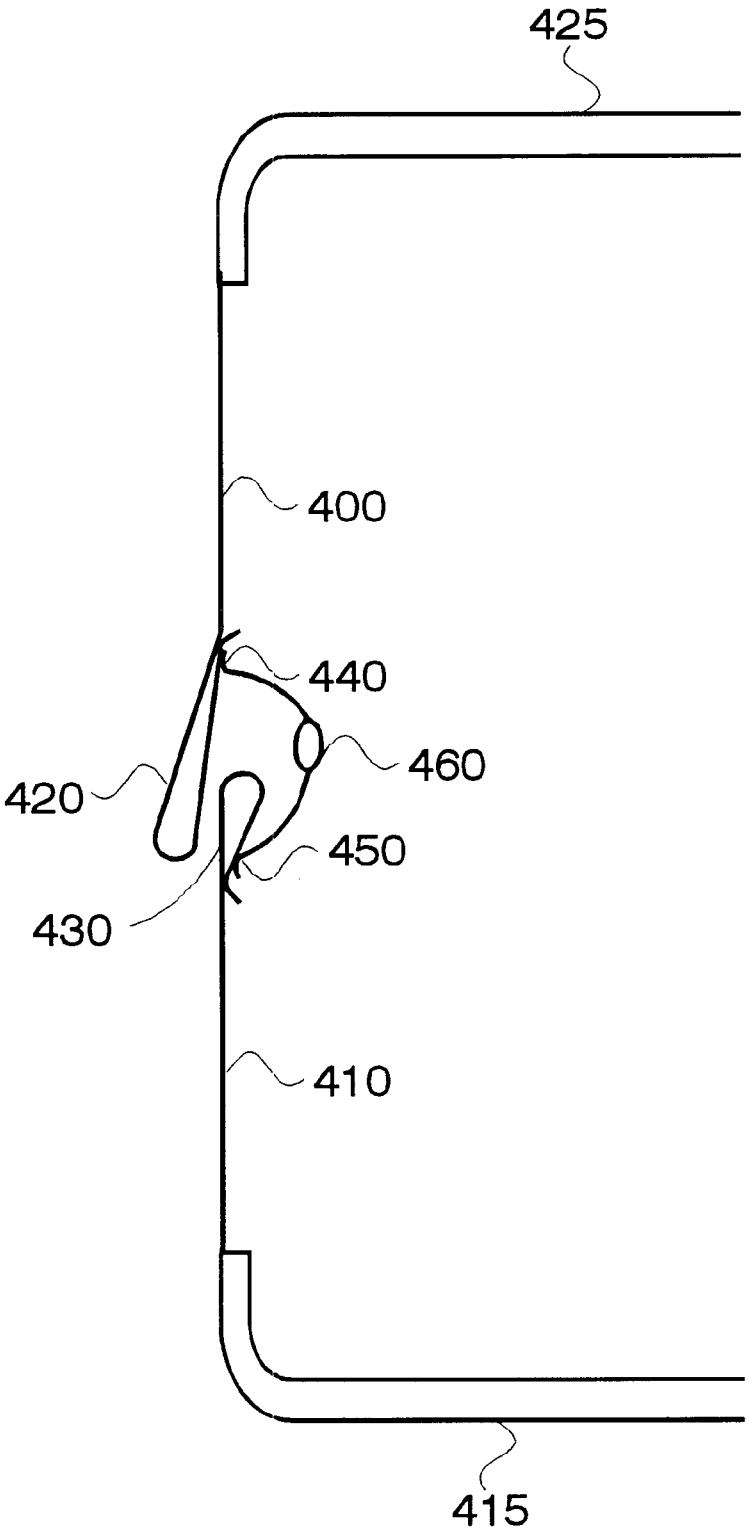
FIG. 4 illustrates a cross-section view of how the upper assembly section and lower assembly section appear after the zipper has been zipped.

The opening created by zipper 130 between upper fabric assembly 140 and lower fabric assembly 150 is used to access the interior storage space of luggage bag 100. It should be noted that zipper line 120 and zipper 130 shown in FIG. 1 are only for illustrative purposes. In one embodiment of the present invention, a fabric flap covers the zipper line 120 and zipper 130, as illustrated in FIG. 4. Other embodiments use other methods of coupling the upper fabric assembly with the lower fabric assembly.

The Fabric Assembly And Pan Coupling

Figure 2A:
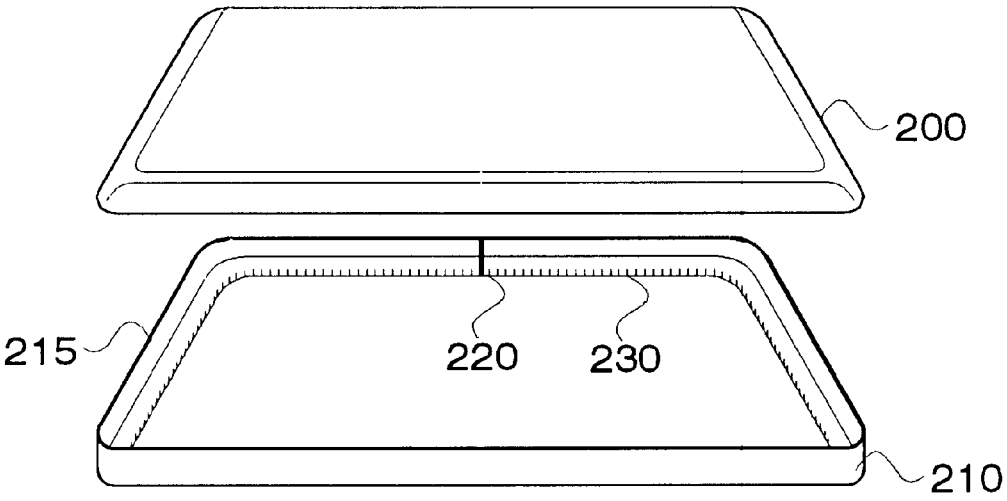

FIG. 2*a* illustrates a detailed view of the upper portion of the luggage. The upper fabric assembly 210 is depicted prior to radio frequency welding to thermoplastic upper pan 200. An upper zipper line 230 is coupled to the lower edge of the upper fabric assembly 210. In one embodiment, the upper zipper line 230 is placed on the interior of the upper fabric assembly 210. This interior placement of upper zipper line 230 provides a connection mechanism that is not visible to the eye from the exterior of the luggage. Upper fabric 210 assembly also includes a radio frequency welded seam 220 at the rear of the luggage.

As previously stated, a polyurethane film layer is coated or laminated to the surface or surfaces of upper fabric assembly 210 before the radio frequency welding. The polyurethane film is used to form a permanent adhesive waterproof coating, and facilitates radio frequency welding of upper fabric assembly 210 to upper thermoplastic pan 200.

Figure 2B:
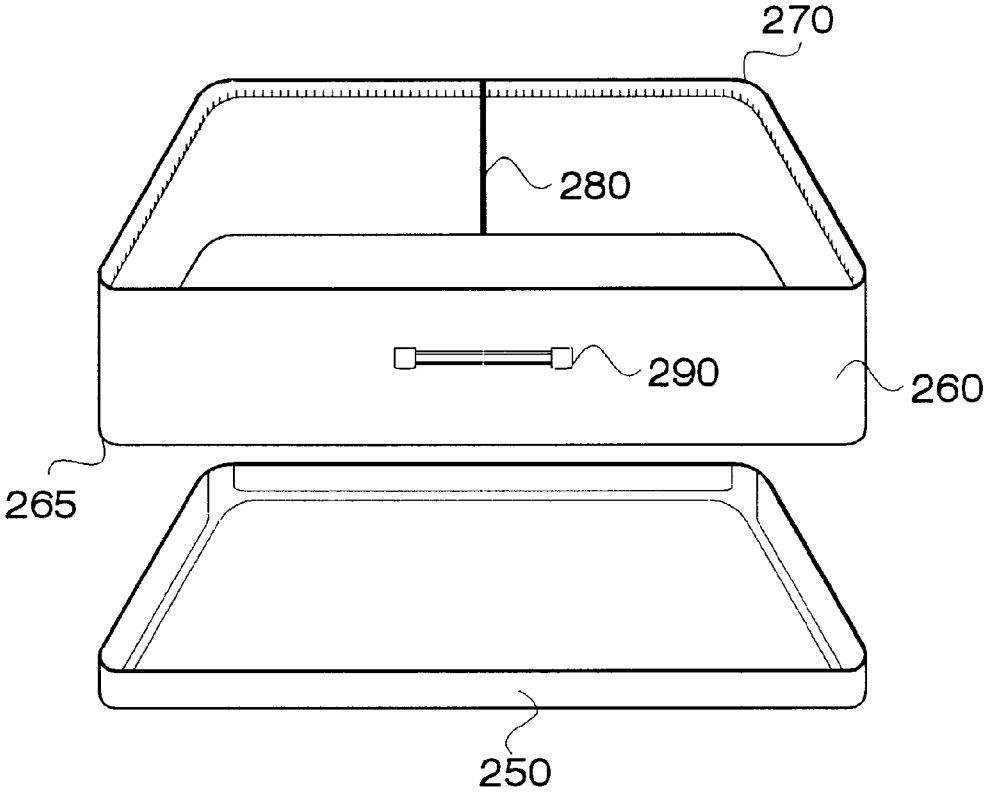
Figure 2C:
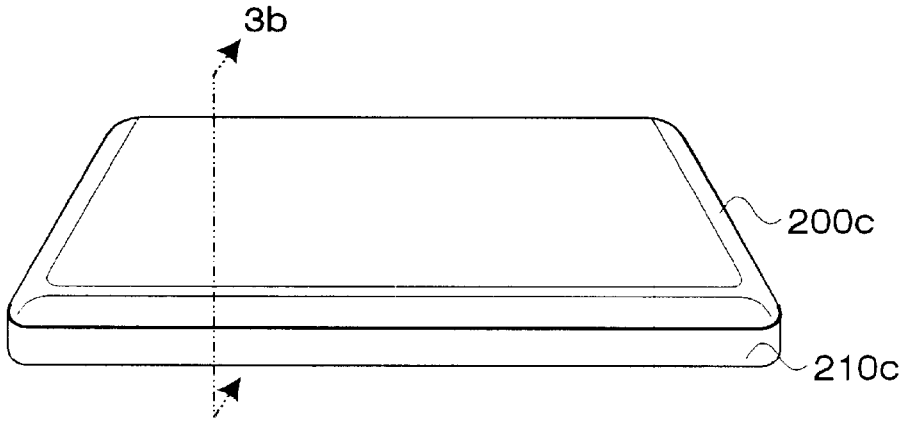
Figure 2D:
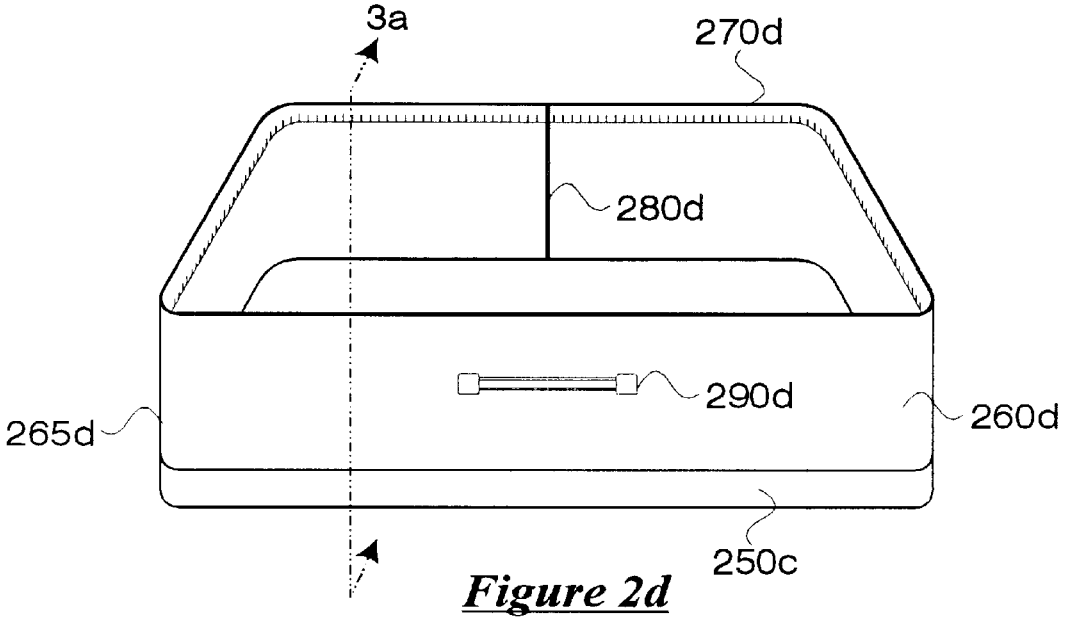

FIG. 2*b* illustrates a view of lower fabric assembly 260 prior to radio frequency welding to the bottom thermoplastic pan 250. A lower zipper line 270 is coupled to the upper edge of lower fabric assembly 260. In the embodiment of FIG. 2*b*, the lower zipper line 270 is placed on the interior of the lower fabric assembly 260. This interior placement of lower zipper line 270 provides a zipping mechanism that is not visible to the eye from the exterior of the luggage. Lower fabric assembly 260 also includes a welded seam 280 at the rear of the luggage.

To facilitate transport, a handle 290 is radio frequency welded to lower fabric assembly 260. In an alternate embodiment, a shoulder strap (not shown) is coupled to two of the sides of the lower fabric assembly 260. The shoulder strap keeps the luggage in the orientation shown in FIG. 2*a* and FIG. 2*b* such that only the rugged thermoplastic lower pan 250 contacts the ground.

Through careful placement of zippers and the use of radio frequency welding to attach straps/handles, an esthetically pleasing and water resistant bag is designed. Further, by adding all the necessary straps and zippers prior to the radio frequency welding of the top or bottom pan a simplified construction process is provided.

The Zipper Design

Figure 3A:
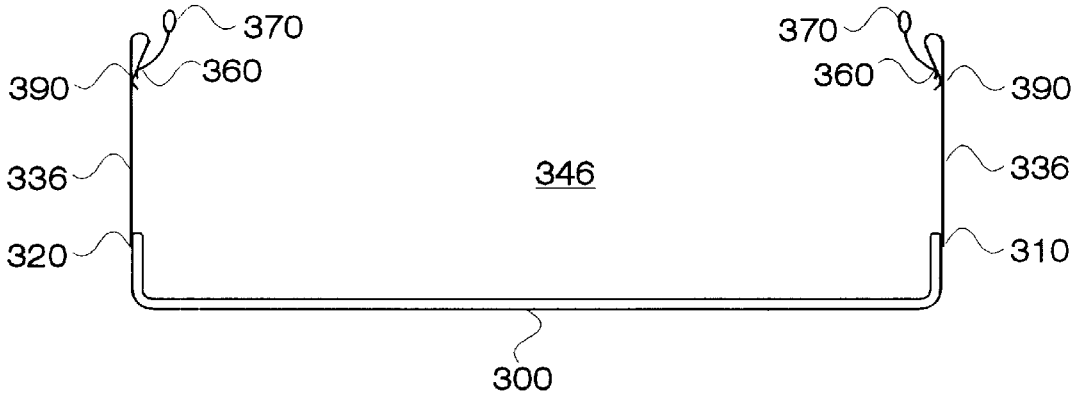

FIG. 3*a* illustrates a cross section of the lower section 346 of the luggage. The lower section 346 comprises the lower thermoplastic pan 300, the lower fabric assembly 336, radio frequency weld points 310 and 320, and the zipper line 370 attached to the lower fabric assembly 336. In the embodiment of FIG. 3*a*, the zipper line 370 is stitched to lower fabric assembly 336 in a manner that protects the zipper from outside elements by using a flap of fabric. The zipper line 370 is first stitched to the outside surface of the lower fabric assembly 336 with stitch 360 such that the zipper line is pointing downwards. The lower fabric assembly 336 is then folded inward back onto itself and radio frequency welded at weld point 390. This subsequent folding and welding places stitch 360 on the interior part of the luggage design where it is not visible. Furthermore, the folded flap of fabric that extends from weld point 390 acts as a shield to protect zipper mechanism 370 from damage.

Figure 3B:
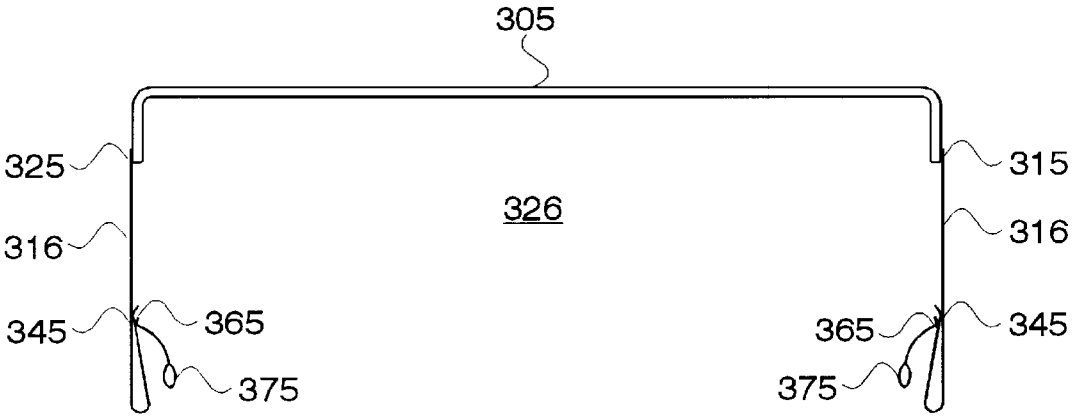

FIG. 3*b* illustrates a cross section of the upper section 326 of the luggage. The upper section 346 comprises the upper thermoplastic pan 305, the upper fabric assembly 316, radio frequency weld points 310 and 320, and the zipper line 375 attached to the upper fabric assembly 316. Like the zipper line 370 from the lower section 346 of the luggage, the zipper line 375 is stitched to upper fabric assembly 316 in a manner that protects the zipper line 375 from outside elements by using a flap of fabric. In particular, the upper fabric assembly 316 is folded back onto itself and radio frequency welded at weld point 345. This subsequent folding and welding places stitch 365 in the interior part of the luggage. However, in the case of the zipper 375 coupled to the upper fabric assembly 316, the fabric flap is made a little larger than the flap on the lower fabric assembly 336.

The larger flap on the upper fabric assembly 316 will lay over the flap from the lower fabric assembly 336. FIG. 4 illustrates this effect by presenting a cross section view of the coupling between upper fabric 400 and a lower fabric 410. As seen in FIG. 4, the upper flap 420 over laps the lower flap 430 to form a protective seal over the coupled zip mechanism 460. Any rain or debris that runs down the side of the upper fabric piece 400 will continue downward without affecting the zipper 460 or the interior of the luggage.

The upper flap 420 and lower flap 430 also add to the esthetic appeal of the luggage. Specifically, the upper flap 420 and lower flap 430 hide the stitches 440 and 450 used to attach the upper and lower zipper lines from the exterior of the luggage. Thus, the fold over construction of the fabric walls create a zipper construction that both protects the zipper from damage and hides the unsightly stitches from the exterior of the luggage. Thus, the zipper design adds to the esthetic appearance of the luggage while providing increased durability and water resistance.

The Tooling Mechanism

Figure 5:
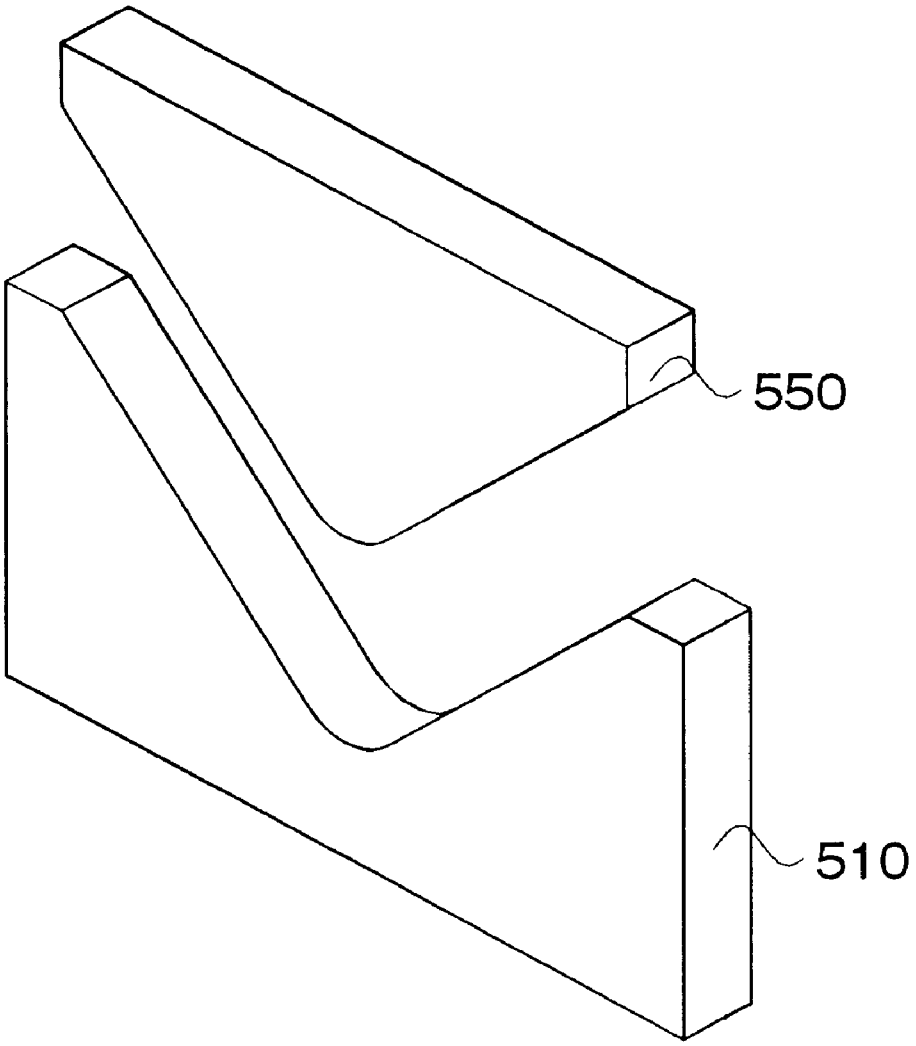
FIG. 5 illustrates a special tooling assembly for a radio frequency welder that is designed for welding the fabric sections to rectangular thermoplastic pans.

To weld the fabric assemblies to the thermoplastic elastomer pans, a special radio frequency tooling assembly was created. FIG. 5 illustrates the radio frequency tooling assembly used to help create the luggage illustrated in FIG. 1. The radio frequency tooling assembly of FIG. 5 was particularly designed for created rectangular luggage items. However, the shape of the radio frequency tooling assembly can easily be modified to accommodate pans having different shapes.

The base 510 of the radio frequency tooling assembly provides a ninety degree corner in which a corner of a rectangular thermoplastic elastomer pan can be placed. The fabric to be welded to the rectangular thermoplastic elastomer pan is also placed in the base 510 after a layer of polyurethane film has been applied. The radio frequency transmitter 550 is then brought down in contact with the fabric and the rectangular thermoplastic elastomer pan such that the fabric and the rectangular thermoplastic elastomer pan are sandwiched between the radio frequency transmitter 550 and the base 510. The radio frequency weld is then performed.

To fully attach a fabric assembly to a rectangular thermoplastic elastomer pan, three more welds must be performed. Specifically, the three remaining corners to the rectangular shaped thermoplastic elastomer pan must be radio frequency welded to the fabric side.

In the foregoing specification the invention has been described with reference to a specific exemplary embodiment thereof. It will, however, be evident that various modifications and changes may be made thereto without departing from the broader spirit and scope of the invention as set forth in the appended claims. The specification and drawings are, accordingly, to be regarded in an illustrative rather than restrictive sense.

What is claimed is:

1. A piece of luggage having a plurality of components coupled together without any visible exterior stitching, said luggage comprising:

a bottom component having a top side and a bottom side wherein said first component is formed from a thermoplastic elastomer;

a first fabric having a top edge and a bottom edge, wherein said bottom edge of said first fabric is coupled to the top side of the bottom component along a circumference of said bottom component using a first radio frequency weld;

a zipper mechanism coupled to said top edge of said first fabric using a second radio frequency weld;

a second fabric having a top edge and a bottom edge, wherein said bottom edge of said second fabric is coupled to said zipper mechanism using a third radio frequency weld, said top edge of said first fabric and said bottom edge of said second fabric overlap to hide said zipper mechanism from exterior of said luggage; and a third top component having a top side and a bottom side, wherein said bottom side of said top component is coupled to said top edge of said second fabric along the circumference of said top component using a fourth radio frequency weld.

2. The piece of luggage as claimed in claim 1 wherein said top component is formed from a thermoplastic elastomer.

3. The piece of luggage as claimed in claim 1 wherein said top edge of said first fabric is folded prior to using said second radio frequency weld.

4. The piece of luggage as claimed in claim 1, wherein a polyurethane film is placed between said bottom component and said bottom edge of said first fabric prior to said first radio frequency weld.

5. The piece of luggage as claimed in claim 1, wherein a polyurethane film is placed between said top component and said top edge of said second fabric prior to said fourth radio frequency weld.

* * * * *